United States Patent [19]

Schwartz

[11] Patent Number: 4,932,011

[45] Date of Patent: Jun. 5, 1990

[54] THREE HAND MOVEMENT FOR A TIMEPIECE WITH IMPROVED TIMESETTING GEAR TRAIN

[75] Inventor: Herbert Schwartz, Wurmberg, Fed. Rep. of Germany

[73] Assignee: Timex Corporation, Waterbury, Conn.

[21] Appl. No.: 432,016

[22] Filed: Nov. 6, 1989

[51] Int. Cl.[5] ..... G04B 17/12; G04B 27/02

[52] U.S. Cl. ..... 368/185; 368/190

[58] Field of Search ..... 368/76, 80, 185–191, 368/319–321

[56] References Cited

U.S. PATENT DOCUMENTS

| | | | |
|---|---|---|---|
| 3,487,633 | 1/1970 | Wuthrich | 368/185 |
| 3,548,587 | 12/1970 | Wood | 368/191 |
| 3,731,481 | 5/1973 | Nakayama | 368/191 |
| 3,837,161 | 9/1974 | Wuthrich | 368/191 |
| 4,426,158 | 1/1984 | Muller et al. | 368/76 |
| 4,623,261 | 11/1986 | Muto | 368/80 |
| 4,794,576 | 12/1988 | Schwartz et al. | 368/185 |
| 4,845,693 | 7/1989 | Kubota | 368/190 |
| 4,888,949 | 12/1989 | Schwartz et al. | 368/157 |

*Primary Examiner*—Vit W. Miska

*Attorney, Agent, or Firm*—William C. Crutcher

[57] ABSTRACT

A three hand movement of the type having a frame, a stepping motor mounted in the frame, a manually actutable timesetting stem disposed in the frame and a gear train driven by the stepping motor to rotate coaxial members carrying "seconds", "minutes", and "hours" hands. An improved dual reduction gear assembly comprises a first rotatable member with a toothed wheel and a second rotatable member having first and second pinions driving the "hours" and "minutes" wheels. A timesetting gear is adapted to be clutched to the "minute wheel". A friction coupling connects the first and second rotatable members during timekeeping. During timesetting, the friction coupling slips to disengage the toothed wheel from the first and second pinions, so that the second rotatable member separately functions as a reduction gear during timesetting.

7 Claims, 4 Drawing Sheets

THREE HAND MOVEMENT FOR A TIMEPIECE WITH IMPROVED TIMESETTING GEAR TRAIN

BACKGROUND OF THE INVENTION

This invention relates generally to movements for timepieces using a crown to manually set the hands of the timepiece. More particularly, the invention relates to improved timesetting and a dual reduction gear assembly suitable for use in a three hand movement for a quartz analog wristwatch. Various constructions are known for setting the hands of wristwatches by pulling out a crown attached to a stem and manually rotating the stem, which is coupled to an internal gear engaging with the gear train to turn the hands. In a three hand wristwatch, in order to prevent the "seconds" hand from spinning too rapidly during timesetting, a common expedient is to provide means to arrest the motion of the "seconds" wheel and to include a slipping friction coupling somewhere in the gear train to permit only that portion of the gear train to turn which rotates the "minutes" hand and the "hours" hand. Such a friction coupling device permitting slipage during hand setting is seen in U.S. Pat. No. 3,487,633, issued Jan. 6, 1970 to P. Wuthrich. A three hand quartz analog movement generally employs a stepping motor to drive the "seconds" wheel, a wheel and pinion reduction gear assembly to drive the "minutes" wheel from the "seconds" wheel and another wheel and pinion reduction gear assembly to drive the "hours" wheel from the "minutes" wheel.

A three hand wristwatch movement is disclosed in U.S. Pat. No. 4,426,158, issued Jan. 17, 1984 to Mueller et al., which incorporates a stepping motor rotor having a two-pin pinion driving a seconds wheel and seconds spindle. Coaxially disposed around a post supporting the seconds spindle from the stepping motor stator are two rotatable sleeves with connected wheels, one for the minutes and the other for the hours. A pair of wheel and pinion reduction gear assemblies are coaxially mounted to rotate with respect to one another and with respect to the stationary bearing support. One such wheel and pinion reduces the speed to drive the minutes wheel. The other wheel and pinion is driven by a pinion on the minutes spindle and reduces speed further to drive the hours wheel. This construction requires a pair of coaxially mounted reduction gear assemblies which are continuously rotatable with respect to one another as well as with respect to the stationary bearing support.

The aforementioned Mueller Patent No. 4,426,158 employs a setting mechanism for the hands which causes a timesetting gear train engaged with one of the aforesaid wheel and pinion reduction gears to turn the hands, and requires engaging and disengaging one set of gears to set the time, a process which offers the possibility of breakage of teeth.

An improved three hand movement which eliminates one set of gears used in the aforesaid Mueller patent is disclosed in pending U.S. application Ser. No. 07/303,413 filed Jan. 30, 1989 in the name of H. Schwartz and P. Wuthrich and assigned to the present assignee. The improvement comprises a dual reduction gear assembly with a single shaft rotatably mounted in the frame having a toothed third wheel driven by the reduction drive pinion and having a first reduction pinion and second reduction pinion directly driving the hours and minutes wheels, respectively, from the same shaft. In the preferred embodiment, the rotor pinion, the reduction drive pinion, and first reduction pinion are of the two-pin type, while the second reduction pinion is an ordinary spur gear.

Accordingly, one object of the present invention is to provide an improved three hand timepiece movement which provides an improved timesetting mechanism and fewer parts.

Another object of the present invention is to provide an improved timesetting reduction gear for a three hand quartz analog wristwatch movement.

DRAWINGS

The invention, both as to organization and method of practice, together with further objects and advantages thereof, will best be understood by reference to the following specification, taken in connection with the accompanying drawings, in which.

SUMMARY OF THE INVENTION

Briefly stated, the invention comprises an improvement in a three hand movement of the type having a frame, a stepping motor mounted in the frame, a manually actuatable timesetting stem disposed in the frame and a gear train driven by the stepping motor to rotate coaxial members carrying "seconds", "minutes", and "hours" hands. The invention comprises improvements in the gear train, wherein the seconds spindle drives a dual reduction gear assembly. The assembly comprises a first rotatable member with a toothed wheel and a second rotatable member having first and second pinions driving the "hours" and "minutes" wheels. A timesetting gear is adapted to be clutched to the "minute wheel". A friction coupling connects the first and second rotatable members during timekeeping. During timesetting, the friction coupling slips to disengage the toothed wheel from the second rotatable member first and second pinions, so that the first and second pinions separately functions as a reduction gear during timesetting.

DESCRIPTION OF THE PREFERRED EMBODIMENT

Figure 1:
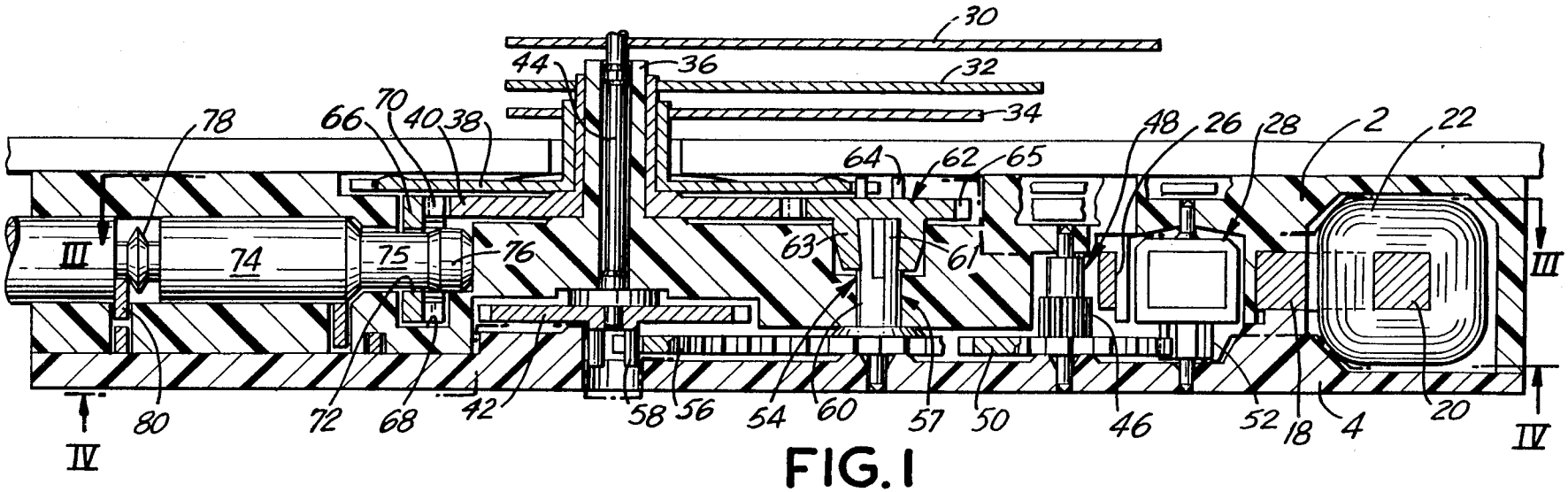
FIG. 1 is an elevation view in cross section which is developed along the zig-zag lines I—I of FIG. 2.
Figure 2:
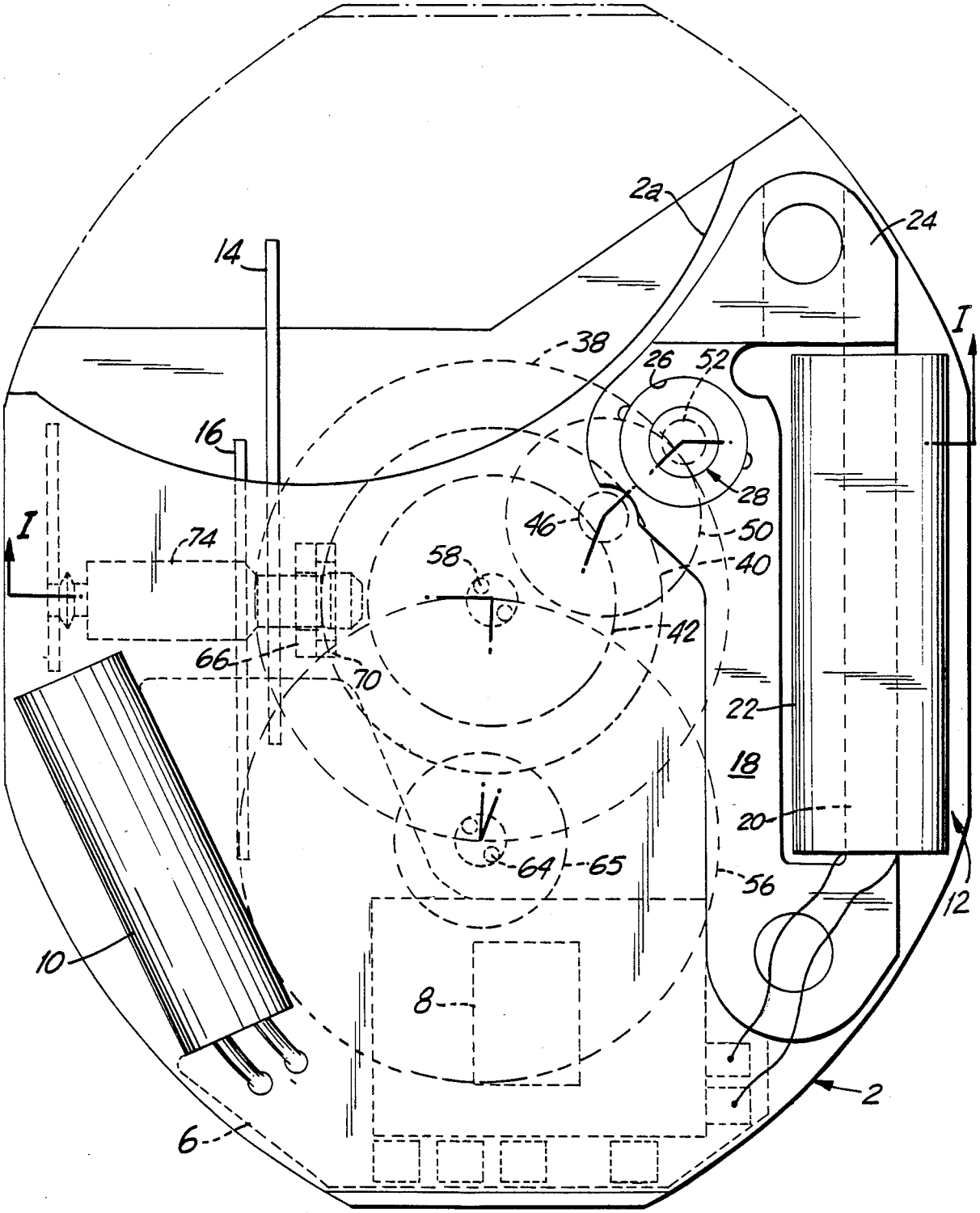
FIG. 2 is a top plan view of the watch movement in simplified schematic form showing the external outline diameters of the gear train elements.

Referring to FIG. 1 of the drawing, a timepiece movement comprises a plastic frame 2, and a plastic bridge 4, cooperating therewith to hold the timepiece components and rotating gear train. As shown in the plan view of FIG. 2, the frame 2 contains a printed circuit board 6 having an integrated circuit 8 disposed thereon, a quartz crystal 10 a stepping motor shown generally at 12. Frame 2 includes a cutout recess 2a adapted to receive various sizes of energy cells (not shown) which are connected to supply power to the elements on the printed circuit board 6 by means of first and second energy spring contacts 14, 16.

The stepping motor 12 comprises a stator 18 with core piece 20 inside a coil winding 22, the magnetic circuit being closed by a stator bridging element 24. Stator 18 further includes an opening 26 forming a pair of magnetizable pole shoes surrounding a two pole permanent magnet rotor 28. The type of construction of the stepping motor is immaterial to the present invention, but suitable arrangements may be seen in U.S. Pat. No. 4,720,644, issued Jan. 19, 1988 to A. Sedlak or in U.S. Pat. No. 4,795,930 issued Jan. 3, 1989 to H. Schwartz and G. Stotz, both assigned to the present assignee.

Frame 2 and bridge 4 together serve to rotatably mount the elements of a gear train used to drive a sweep second hand 30, a minute hand 32 and an hour hand 34. Hands 32, 34 are mounted on coaxial sleeves rotatably mounted on a frame extension post 36. Hand 34 is turned by an "hours" wheel 38. Minute hand 32 is turned by a "minutes" wheel 40, sometimes known as a center wheel. A "seconds" wheel 42 is fixed to the end of a seconds spindle 44 to rotate the sweep second hand 30. "Seconds" wheel 42 meshes with, and is driven by pinion 46 of an intermediate reduction gear assembly shown generally as 48. Meshing of gears 42, 46 can not be seen in the developed view of FIG. 1, but may be seen in the plan view of FIG. 2. Intermediate reduction gear assembly 48 has a wheel 50 which meshes with pinion 52 of the stepping motor rotor 28. In this manner, the stepping motor rotor 28 drives the "seconds" wheel 42 as an intermediate reduction gear.

In accordance with the present invention, a dual reduction gear assembly 54 with a friction coupling incorporated therein is rotatably mounted in the frame. Reduction gear assembly 54 comprises a wheel 56 driven by a two-pin pinion 58 attached to "seconds" wheel 42. Wheel 56 is rotatably mounted within a bore in the frame by means of a stub shaft 60 on one end thereof having a slotted end 61. Shaft 60 and wheel 56 comprise a first rotatable member 57. A second rotatable member 62 includes a hub 63 forming a friction coupling with the slotted end 61. The second rotatable member 62 includes a two pin pinion 64 engaging teeth of the hour wheel 38 and a spur tooth pinion 65 engaging the teeth of "minutes" wheel 40.

Also engaging the teeth of the minutes wheel 40 is a timesetting gear 66, which is disposed in a cavity 68 in the frame with its axis perpendicular to the other rotating gear members. Timesetting gear 66 has crown teeth 70 extending parallel to its axis of rotation which are engaged with the teeth of the "minutes" wheel 40 at all times. The timesetting gear has an inner bore 72. A timesetting stem 74 attached to a crown (not shown) is both axially movable and rotatable within the frame. Stem 74 includes a reduced diameter portion 75 extending through the bore 72 and a friction clutch comprising a larger diameter portion 76 which will engage within bore 72 with a friction fit when the stem 74 is pulled to the left. The walls of cavity 68 prevent disengagement of gear 66. In this manner, stem 74 may be coupled to the minutes wheel 40. In order to retain the stem 74 in timesetting engagement or disengagement positions, a detent member 78 cooperates with a stem detent spring 80 located in the frame.

Figure 3:
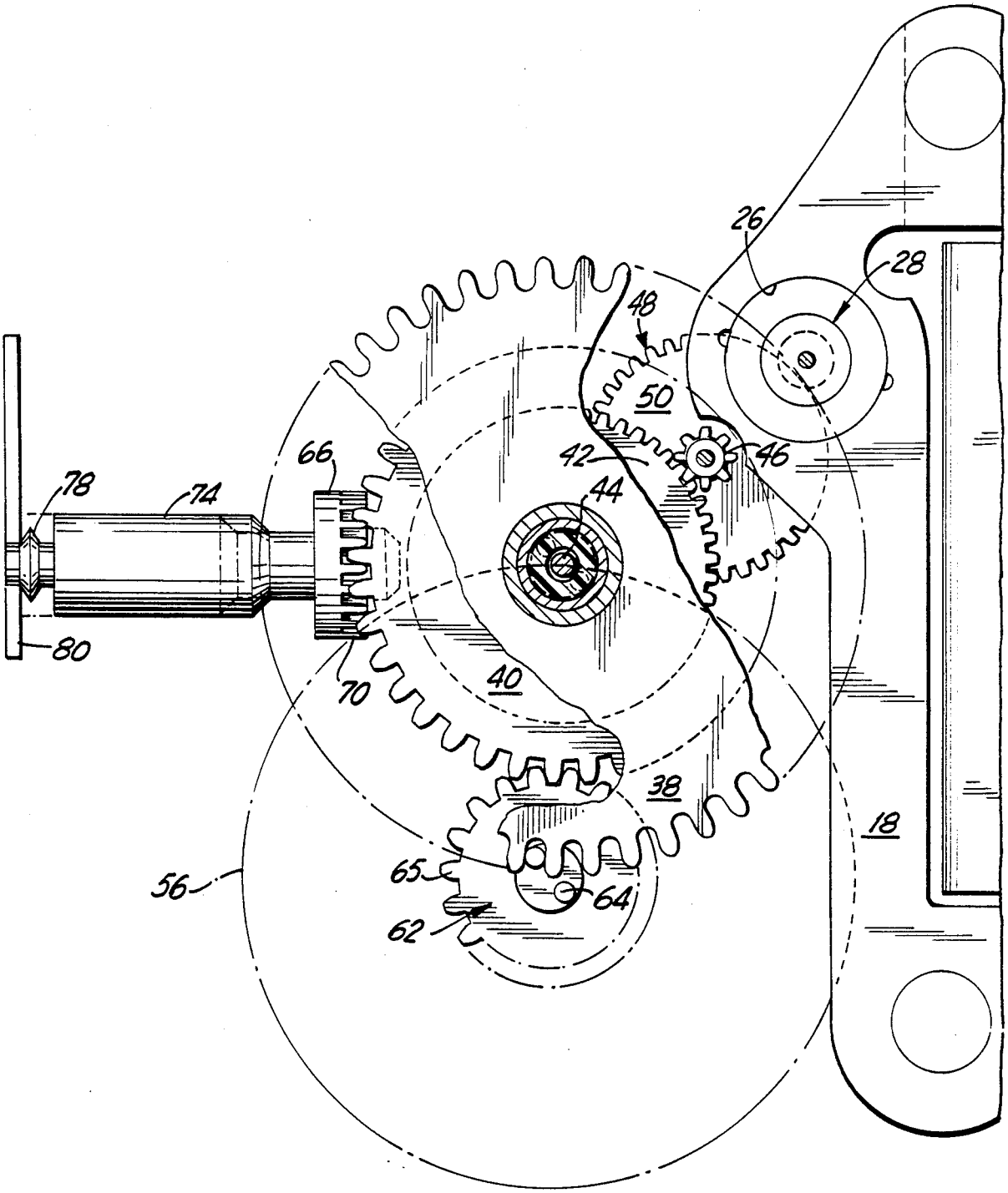
FIG. 3 is a top plan view along lines III—III of FIG. 1, partially broken away to illustrate the meshing gear teeth, showing only the gear train, stepping motor and timesetting in order to illustrate operation.

Reference to FIG. 3 of the drawing illustrates a top plan view showing only the gear train, portions of the stepping motor and setting gear with sections broken away to show the shape of the teeth. The seconds spindle 44 is driven from the stepping motor rotor 28 by means of the intermediate reduction gear assembly 48 through ordinary spur teeth on pinion 52 of stepping motor rotor 28 driving wheel 50, and pinion 46 driving wheel 42.

Figure 4:
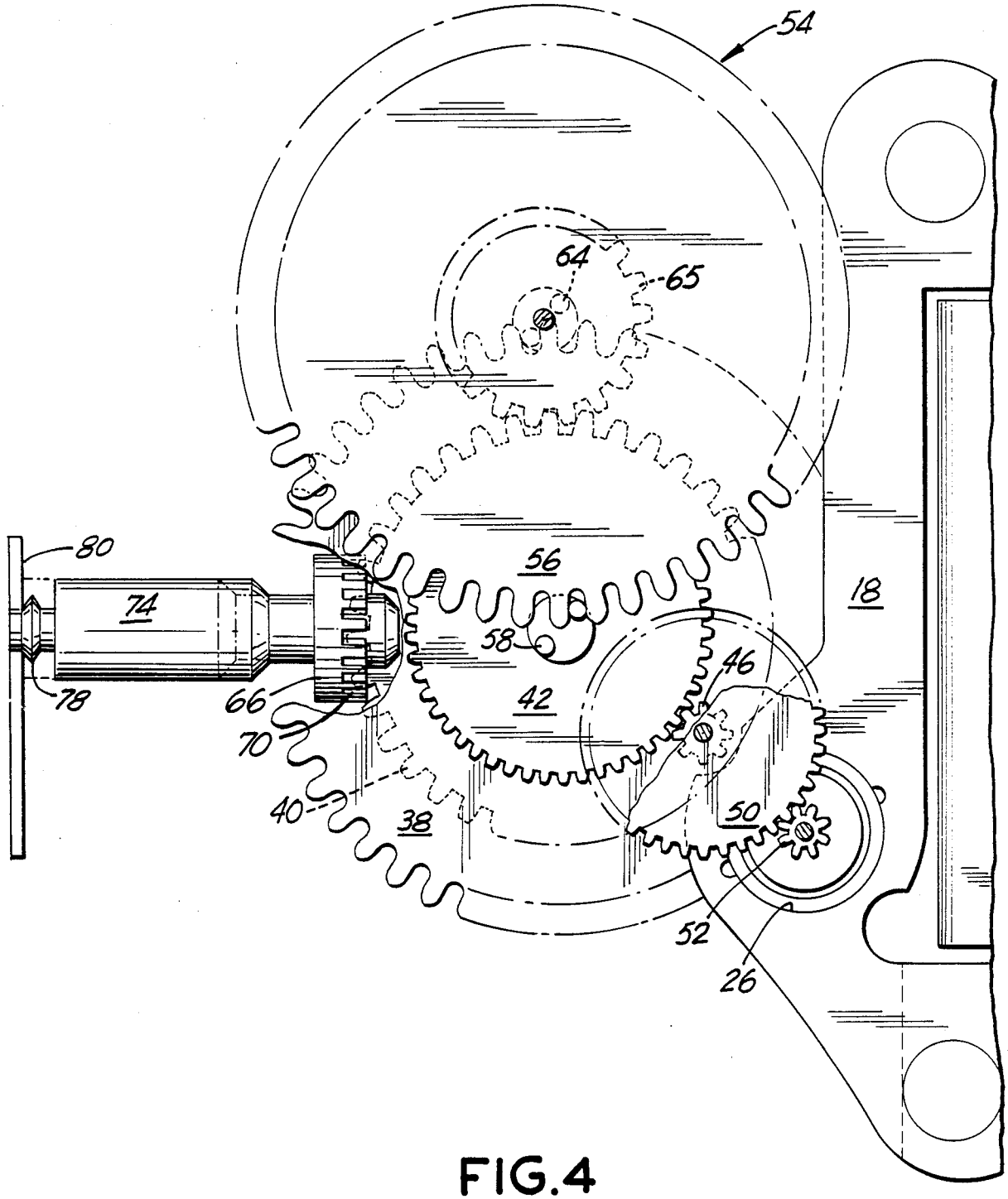
FIG. 4 is a bottom plan view similar to FIG. 3 along lines IV—IV of FIG. 1, again only illustrating gear train, stepping motor and timesetting gear.

Reference to FIG. 4 of the drawing illustrates a bottom plan view showing only the gear train, stepping motor and timesetting gear with portions of the gears removed to show the gear train. In both FIGS. 3 and 4, the stem 74 is illustrated in the disengaged position, so that the timesetting crown gear 66 is free to continuously turn.

As seen in FIG. 4, the "seconds" wheel 42 rotates the two-pin pinion 58 to drive the toothed wheel 56 of the dual reduction gear assembly 54. Wheel 56 has teeth which are "ogival" in shape rather than ordinary spur teeth. Such "ogival" teeth have pointed tips which guide the pins of the pinion 58 into the slots between the teeth. The adjacent flanks of each pair of adjacent teeth are parallel to one another. Wheel 56 has sixty ogival teeth; this provides a gear reduction of 1:30 in the example shown.

Reference to FIG. 3 of the drawing illustrates that one of the pinions 65 of the second rotatable member 62 has eighteen ordinary spur teeth meshing with thirty-six teeth of minute wheel 40. Any suitable ratio may be used providing a 1:2 reduction. The two-pin pinion 64, on the other hand, cooperates with forty-eight ogival teeth on "hours" wheel 38 providing a 1:24 reduction. Therefore, the dual reduction gear assembly turns the wheels 38, 40 at two different speeds with wheel 40 required to make 12 revolutions while wheel 38 makes one revolution.

Figure 5:
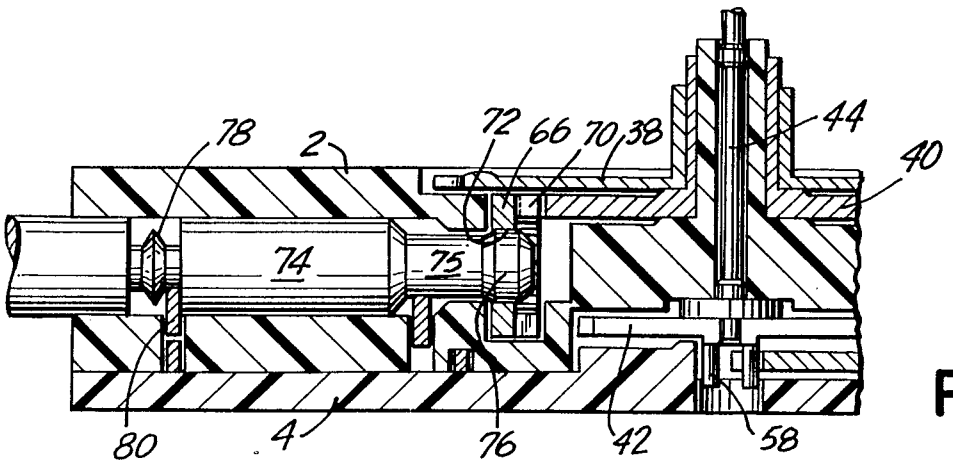
FIG. 5 is a partial elevation view similar to FIG. 1 with the timesetting gear friction clutch engaged.

The timesetting crown gear 66 is engaged with the spur teeth of "minutes" wheel 40 and idle during normal timekeeping. However, when stem 74 is withdrawn to set the time, the stem is coupled to crown gear 66 by the friction clutch. FIG. 5 is the same as FIG. 1, except that stem 74 is shifted axially to the left and retained in this position by detent spring 80 cooperating with spring detent 78. The friction engaging surface 76 on the stem provides a friction fit within the bore 72 of crown gear 66. Manual rotation of the time setting stem from the watch crown will rotate the minute wheel 40. Minute wheel 40 attempts to rotate the reduction gear assembly 54. However, since the gear train consisting of the "second" wheel 42, intermediate reduction gear assembly 48 and stepping motor rotor 28 are locked by gear inertia so that they cannot rotate, the first rotatable member 57 and its wheel 56, which is also coupled to this portion of the gear train cannot rotate. This causes slipage to take place between stub shaft slotted end 61 and hub 63. Therefore, the second rotatable member 62 now acts as an intermediate wheel and pinion reduction gear to drive hours wheel 38 from the "minutes" wheel 40. Setting of the hours and minute hands can thus proceed by rotating stem 74 with the sweep second hand locked in position by the gear train inertia.

OPERATION

Operation of the invention is best summarized by reference to the top and bottom plan view of FIGS. 3 and 4 respectively. Normal timekeeping drive of the three hand movement is seen in FIG. 4 to proceed from the pinion 52 of the stepping motor rotor to drive intermediate wheel 50, whose pinion 46 drives "seconds" wheel 42 and the attached sweep second hand. The two-pin pinion 58 on the seconds spindle drives the dual reduction gear wheel 56 which is frictionally coupled to with its two output pinions 64, 65. Pinion 64 drives the "minutes" wheel 40 with attached minute hand through a spur gear reduction. Pinion 64 drives the ogival teeth of hours wheel 38 with the attached hours hand. The crown gear 66 of the stem setting mechanism idles on minute wheel 40.

When it is desired to set the hands of the timepiece, stem 74 is pulled to couple the stem 74 to minute wheel 40. As best seen in FIG. 3, rotation of stem 74 turns minutes wheels 40, which through its spur gear teeth rotates second rotatable member 62 of the dual reduction gear as a driven wheel. The two pin pinion 64 rotates the hours wheel 38, thereby setting the hours and minutes hand. Hub 63 slips on the stub shaft of the first rotatable member of the dual reduction gear assembly, whose wheel 56 is locked by its engagement with the two-pin pinion 58, the latter being locked in turn by the inertia of the gear train leading to the stepping motor pinion. In this manner, the dual reduction gear performs in a unique way to provide two reductions from frictionally coupled first and second rotatable members turning as a single shaft during normal timekeeping, but allows the second rotatable member to function as an ordinary wheel and pinion reduction gear between hour and minute wheel during timesetting.

An alternative arrangement for the dual reduction gear is to mold the stub shaft 60 and the hub 63 as a single shaft member together with pinions 64, 65 as a single piece comprising the second rotatable member and to provide a friction coupling with the wheel 56 which then acts alone as the first rotatable member.

While there has been described what is considered to be the preferred embodiment of the invention, other modifications will occur to those skilled in the art and it is desired to secure in the appended claims all such modifications as fall within the true spirit and scope of the invention.

I claim:

1. An improved movement for a three hand quartz analog timepiece having a frame member, a stepping motor with a rotor pinion adapted to periodically rotate half a revolution, and a plurality of coaxial output members rotatably mounted in said frame member, said coaxial output members including a seconds spindle adapted to receive a "seconds" hand and having a toothed seconds wheel and a reduction drive pinion connected thereto, said seconds wheel adapted to be driven via an intermediate reduction gear by said rotor pinion, a minutes sleeve adapted to receive a "minutes" hand and having a toothed minutes wheel connected thereto, and an hours sleeve adapted to receive an "hours" hand and having a toothed hours wheel connected thereto, wherein said improvement comprises;

a dual reduction gear assembly rotatably mounted in said frame member, said assembly comprising a first rotatable member including a toothed wheel meshing with and driven by said reduction drive pinion, and a second rotatable member including a first reduction pinion meshing with said hours wheel and a second reduction pinion meshing with said minutes wheel, means for frictionally coupling said first and second rotatable members of the dual reduction gear assembly, whereby said reduction drive pinion directly drives both the minutes wheel and hours wheel through said dual reduction gear assembly during normal timekeeping, and means for manually rotating said minutes wheel to set the time while preventing rotation of said first rotatable member, whereby said second rotatable member acts as a reduction gear between the hours and minutes wheel during time setting.

2. The combination according to claim 1, wherein said first reduction pinion is a two-pin pinion and wherein said second reduction pinion is a spur gear.

3. The combination according to claim 1, wherein said first reduction pinion is a two-pin pinion and wherein said toothed third wheel of said first rotatable member has ogival teeth meshing therewith.

4. The combination according to claim 1, wherein said first rotatable member includes a stub shaft journalled in said stationary member and wherein said second rotatable member has a hub enclosing portions of said stub shaft and providing a friction coupling with said stub shaft.

5. The combination according to claim 1, wherein said means for rotating the minute wheel includes a manually rotatable stem having a crown gear directly engageable with the teeth of said minute wheel.

6. The combination according to claim 1, wherein said means for preventing rotation of said first rotatable member comprises an intermediate reduction gear assembly coupling said seconds wheel with said stepping motor rotor.

7. The combination according to claim 1, wherein said second rotatable member comprises said first and second reduction pinions molded as a single part with a shaft rotatably mounted in said frame, and wherein said first rotatable member comprises said toothed wheel frictionally coupled to said shaft.

* * * * *